United States Patent [19]

Stocker

[11] 4,273,319

[45] Jun. 16, 1981

[54] DOCUMENT SEQUENCER

[75] Inventor: Lester H. Stocker, Phillipsburg, N.J.

[73] Assignee: Bell & Howell Company, Phillipsburg, N.J.

[21] Appl. No.: 910,326

[22] Filed: May 30, 1978

[51] Int. Cl.[3] ..... B41F 13/56

[52] U.S. Cl. ..... 270/21.1; 83/210; 270/32; 270/58

[58] Field of Search ..... 270/32, 21, 37, 45–51, 270/58, 53; 53/447, 435, 460, 474, 520, 237; 83/371, 209, 210–211

[56] References Cited

U.S. PATENT DOCUMENTS 4,034,973 7/1977 Hams ..... 270/21

*Primary Examiner*—Edgar S. Burr
*Assistant Examiner*—A. Heinz
*Attorney, Agent, or Firm*—Griffin, Branigan & Butler

[57] ABSTRACT

An automated "two-up" in-line mailing (AIM) system of the type comprising a continuous sheet web supplier (11), a sheet cutter (13), a registerer (15), a folder (17), a collector sequencer (19), and an envelope inserter raceway (21) is controlled by indicia on a sheet web. A control system includes scanners (55) for sequentially sensing the web indicia (57) upstream of a cutting blade (64) and trailing edge sensors (37, 53) at discharge ends of two collectors (23, 25) in the collector sequencer (19). The two collectors (23, 25) are positioned at discharge ends of channels of the folder (17) for receiving two-up folded individual sheets (61, 63). One collector (25) accumulates the sheets from both the folder (17) and the other collector (23) in sequential order in piles for subsequent discharge.

In one embodiment, the collector sequencer (19) is positioned upstream of the folder (17).

12 Claims, 5 Drawing Figures

FIG. 1
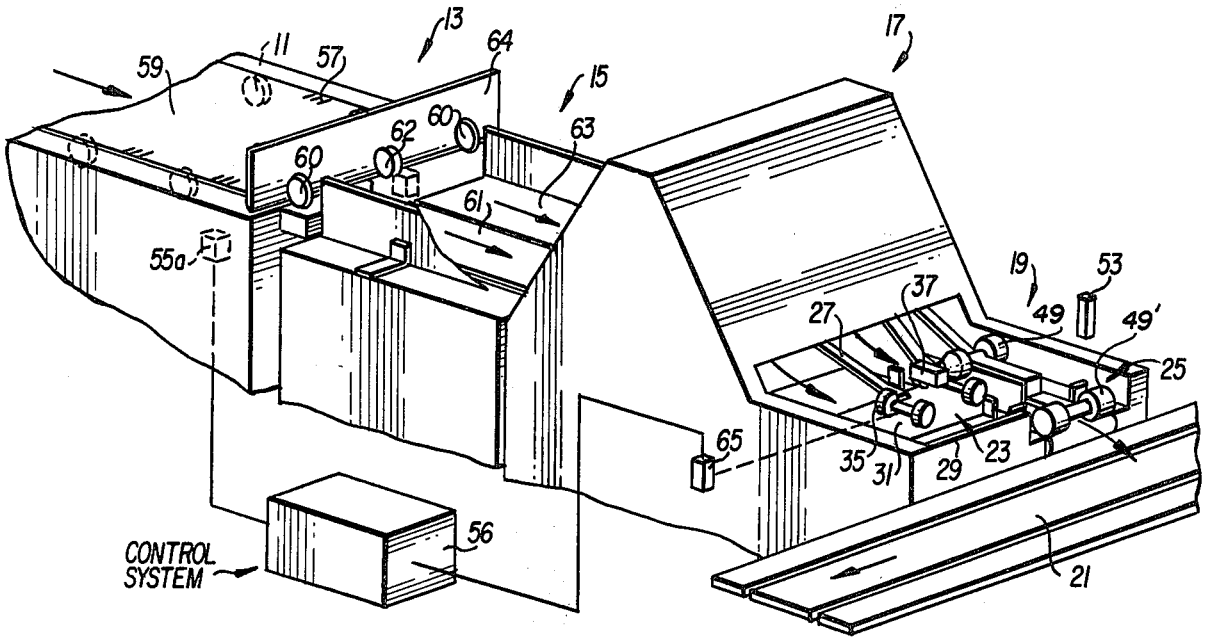
FIG. 3
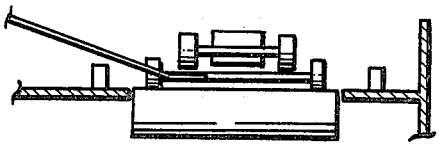
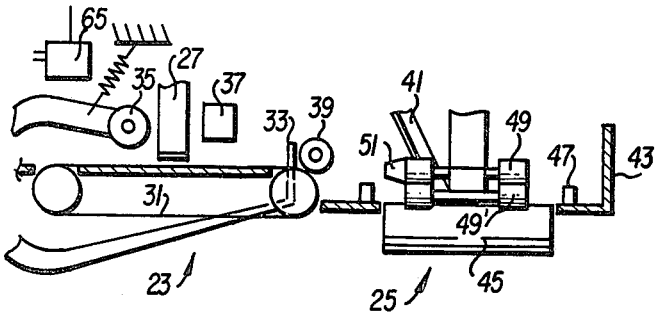
FIG. 4
FIG. 5
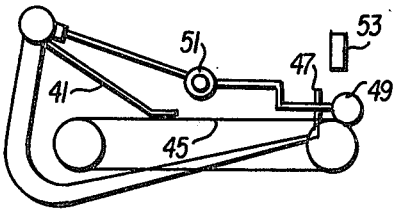

DOCUMENT SEQUENCER

BACKGROUND OF THE INVENTION

This invention relates generally to the art of sheet handling machines, and more specifically to such machines for preparing mass mailings.

Automated in-line mailing (AIM) systems have been designed including cutters, register tables, folders, collectors, and inserters. In such a system described in U.S. Pat. No. 4,034,973 to Hams a cutter receives a preprinted sheet which it cuts into individual sheets. These sheets are sequentially automatically fed to the register table, which straightens them and feeds them to a folder. The folder, in turn, folds the sheets into appropriate sizes and feeds them to a collector which collects the folded sheets until a set corresponding to one letter is collected. The collector then ejects, or "dumps" the set, or letter, onto an insert raceway which moves the letter through insert stations. Appropriate inserts are deposited at the insert station onto the letters. Thereafter, the inserts and letters are stuffed into an envelope which is closed for mailing.

AIM systems have been designed in which indicia are placed on the preprinted sheet web to control operations of various elements of the above-described AIM system. Again, an automated AIM control system of this nature is disclosed by Hams in U.S. Pat. No. 4,034,973.

A difficulty has been encountered in integrating the operations of the various elements of an AIM system as described above when a computer letter in a "two-up" mode is used and the pages of the letter are to be printed sequentially from left to right. Thus, it is an object of this invention to provide an AIM system whereby multiple page letters printed sequentially in a "two-up" configuration from left to right can be assembled into a single letter set in which the numbers of pages may vary from letter set to letter set.

It is a further object of this invention to provide a control system for such an AIM system which responds to instructions contained in indicia preprinted on a sheet web containing the pages of the letter.

It is also an object of this invention to use the elements of existing automated in-line mailing (AIM) systems such as that of Hams in U.S. Pat. No. 4,034,973 coupled to the collector sequencer of the present invention to provide a capability not now available.

SUMMARY OF THE INVENTION

According to principles of this invention, a system is provided for accumulating the individual sheets of a letter in sequential order in an AIM system wherein individual sheets were preprinted, on a sheet web in a two-up configuration, in sequence from left to right. The sheet web has indicia preprinted in at least one disposable margin of the sheet web supplying instructions for disposition of the individual sheets. This instruction information is sensed by a scanner positioned along the margin of the sheet web, and passed to a control system for controlling the accumulation of sheets in a collector sequencer prior to being discharged as a letter set based on the instructions on the indicia.

The collector sequencer has two collector bins, each for receiving the sheets of a channel of the two-up AIM configuration. In response to signals received from the scanner, one collector bin discharges laterally into the other.

BRIEF DESCRIPTION OF THE DRAWINGS

The foregoing and other objects, features, and advantages of the invention will be apparent from the following more specific description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a simplified, isometric view of an AIM system employing principles of this invention;

FIG. 3 is a fragmented sectional view taken on line 3—3 in FIG. 2;

FIG. 4 is a fragmented sectional view taken on line 4—4 in FIG. 2; and, FIG. 5 is fragmented sectional view taken on line 5—5 in FIG. 2.

DESCRIPTION OF PREFERRED EMBODIMENTS

Figure 2:
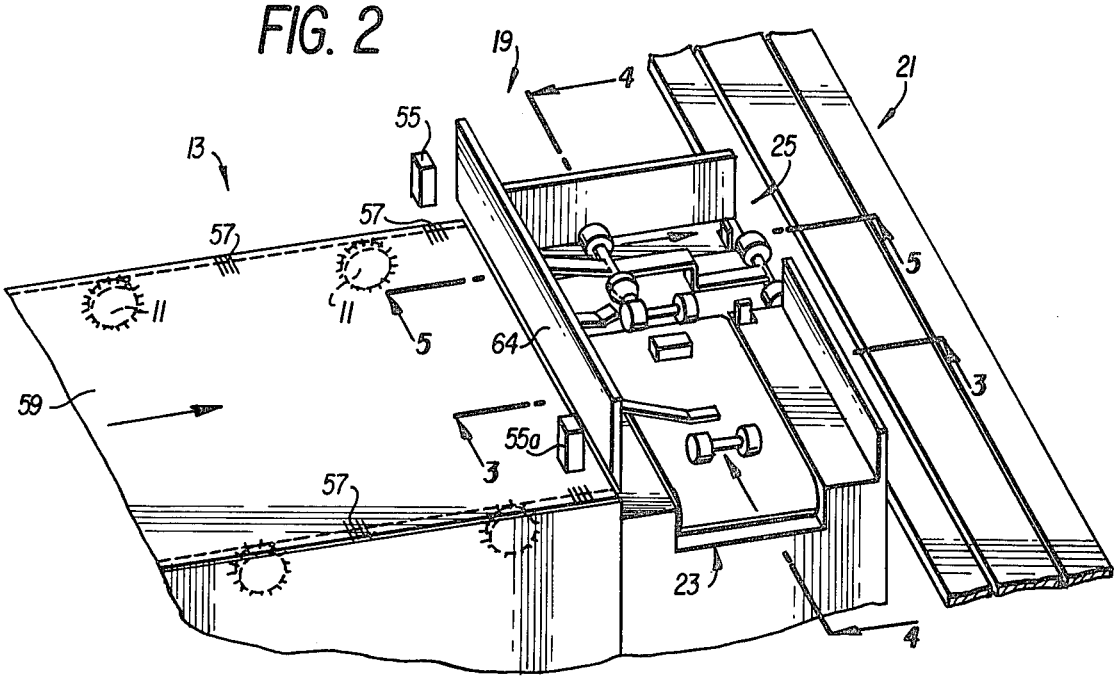
FIG. 2 is a simplified, isometric diagram of a second embodiment of an AIM system employing principles of this invention.

The embodiment of FIG. 1 is described first. It is pointed out that the sectional views of FIGS. 3–5, which were actually taken on FIG. 2, are also applicable for the collector sequencer of the FIG. 1 embodiment.

A two-up (two channels of paper sheets) automated in-line mailing (AIM) system includes toothed wheels 11, a cutter 13, a register 15, a buckle folder 17, a collector sequencer 19, and an insert raceway 21. In this respect, the overall AIM system of FIG. 1 is substantially identical to the two-up mode AIM system depicted in FIG. 2 of U.S. Pat. No. 4,034,973 to Hams, and that patent's disclosure relative to its FIG. 2, with regard to a web-drive control system, a cutter, a register, a folder, and an insert raceway are hereby incorporated by reference herein as a description of corresponding elements of FIG. 1 hereof. The FIG. 1 embodiment of this invention primarily concerns the collector sequencer 19 as it is used in combination with the other elements of the AIM system.

The collector sequencer 19, of the present invention, has left and right collectors 23 and 25 located adjacent to each other and positioned respectively at discharge ends of left and right channels of the buckle folder 17. The left collector 23 has a deflector 27, an abutment wall stop 29, a continuously-running endless conveyor 31, stop gate fingers 33 positioned at a discharge end of the left collector 23, idler rollers 35, a trailing edge sensor 37 positioned at the discharge end of the left collector 23, and deflector rollers 39 positioned at the discharge end of left collector 23.

The right collector 25 has a deflector plate 41 positioned at the discharge end of the right channel of the folder 17, an abutment wall stop 43, a continuously-running conveyor 45, stop fingers 47 positioned at a discharge end of right collector 25, a plurality of idler rollers 49 (one of the idler rollers **49*a* having a coned deflector end 51), and a trailing edge sensor 53 positioned at the discharge end of right collector 25. Basically, the left and right sheet collectors 23 and 25** are the sheet collectors disclosed in U.S. Pat. No. 4,078,790 with minor changes to adapt them to this system. The left collector 23 discharges laterally and the right collector 25 discharges in the general line of sheet travel through the AIM system.

Two scanners 55 are positioned on cutter 13 to sense indicia marks 57 on two margins of a sheet web 59 that is fed into the cutter 13. The right scanner 55*a* is coupled to a control system 56 which includes a timing tape, (not shown) shift registers (not shown), and other elements as are described in detail in U.S. Pat. No. 4,034,973. In the instant system the control system 56 moves signals indicative of the indicia marks 57 along shift registers as an associated sheet moves through the AIM system and transmits such signals to a solenoid 65 when the associated sheet is fed to the left collector 23. If a certain signal is fed to the solenoid it rotates a shaft (not shown) to lower stop fingers 33 and the idler rollers 35 to deposit the sheet that is in the left collector 23 in the right conveyor 25.

In operation of the AIM system of FIG. 1, the sheet web 59 is fed through the cutter 13, its right- and left-hand margins containing feed pinholes and indicia marks are trimmed off by side circular blades 60, it is slit down the center by center circular blade 62, and it is cut laterally by the lateral guillotine cutter 64 to form two individual sheets 61 and 63. The two sheets are fed through the register 15 with the left hand sheet 61 having its left hand edge registered and the right hand sheet 63 having its right hand edge registered. The two sheets are fed into the folder 17 where they are folded and then respectively discharged to the two collectors 23 and 25 in the collector sequencer 19. The right hand individual sheet 63 is fed into the right collector 25 where it is deflected downwardly by the deflector plate 41 and stopped on the continuously-running conveyor 45 by the stop fingers 47, which are in an up position, where it is held. If the right individual sheet 63 is the single sheet of a one page letter it is then discharged to the insert raceway 21. However, if the right individual sheet 63 is just one of a multiple sheet letter it is held for the collection of the remainder of the sheets of the letter. The left hand individual sheet 61 is deflected downwardly into the left collector 23 by deflector 27 and is stopped on the continuous running conveyor 31 by abutment wall stop 29 and stop gate fingers 33. On a signal from the control system 56 stop gate fingers 33 and idler rollers 35 are lowered simultaneously to feed the individual sheet 61 off of the left collector 23. The individual sheet 61 is guided by the deflector rollers 39 and the coned deflector end 51 of the rear pulley of 49 under the plurality of idler rollers. The sheet 61 is stopped on the continuous running conveyor 45 by the abutment wall stop 43. Thus, sheets are accumulated both directly from the folder 17 (sheet 63 in the example) and from the left collector 23 (sheet 61) on the continuous running conveyor 45 until a signal is received through the control system at which time the stop fingers 47 are lowered and simultaneously the plurality of idler rollers 49' are lowered into contact with the top individual sheet sitting on top of the pile of accumulated sheets on the continuous running conveyor 45. The pile of accumulated sheets are thereby discharged to the insert raceway 21. The manner in which control signals are generated and sent to the right collector 25 for "dumping" are fully explained in U.S. Pat. No. 4,034,973 and that explanation is incorporated herein by reference. As the pile of accumulated sheets clears the discharge end of the right collector 25, the trailing edge sensor 53 passes a signal to the control system and the stop fingers 47 are thereby raised into the stop position and the plurality of idler rollers 49' are lifted off of the continuous running conveyor 45.

In another embodiment of the AIM system, as is depicted in FIG. 2, the collector sequencer 19 receives the left individual sheets 61 and the right individual sheets 63 directly from the cutter 13 without having been folded. In this case the sheets are accumulated in a flat configuration before being discharged as a letter set to an insert raceway 21 or a folder 17.

It should be appreciated by those skilled in the art that the collector sequencer assembly described herein is unusually flexible in operation. In this respect, in imprinting letters to long lists of addressees whose letters will be of varying length, this system allows a computer to print the letter pages sequentially from left to right. Further, when this system is used the addressees can be maintained in a zip code order when they are deposited with the inserter which is required by the Post Office.

Further, this system provides the speed of a "two-up" mode AIM system while providing the sequential order of a "one-up" AIM system.

Additionally, the collector sequencer assembly of this invention is extremely reliable and uncomplicated.

While the invention has been specifically shown and described with reference to preferred embodiments, it will be understood by those skilled in the art that various changes in form and detail may be made therein without departing from the spirit and scope of the invention.

The embodiments of the invention in which an exclusive property or privilege are claimed are defined as follows:

1. An automated in-line mailing system including:

a web supply means for supplying a sheet-web having indicia thereon;

a cutter means attached to said web-supply means for receiving said sheet web and cutting said sheet web into side-by-side individual sheets;

a folding means for receiving said individual sheets along adjacent channels from said cutter means and for folding said sheets;

a collector sequencer means for receiving said folded sheets along adjacent channels from said folder means and accumulating said folded sheets respectively received from said adjacent channels in adjacent collector bins, at least one of said collector bins including an ejecting means for ejecting its contents into the other collector bin and the other collector bin including an ejecting means for ejecting its contents to further processing equipment; and a control system including a scanner means for sensing said sheet web indicia upstream of said cutting element, said control system being coupled to at least one collector bin to eject its contents into the other collector bin in response to indicia read from said sheet web by said scanner.

2. An automated in-line mailing system as in claim 1 wherein said at least one collector bin comprises an abutment wall stopping means for stopping the flow of sheets in a first direction, a continuous lateral conveyor means for contacting said sheets and urging them in a lateral direction, a stop-gate-fingers means positioned in the lateral path of said sheets to contact said sheets and thereby prevent them from being driven in the lateral direction by said lateral conveyor means, said stop-gate-fingers means being movable out of said lateral path in response to a signal from said control system.

3. An automated in-line mailing system as in claim 2 wherein said at least one collector bin includes an idler roller which is lowered into contact with said contents of said at least one collector bin for urging said contents against said continuous lateral conveyor means when said stop-gate-fingers means is moved out of said lateral path.

4. An automated in-line mailing system as in claims 3, 2 or 1 wherein said other collector bin comprises an abutment wall stopping means for stopping said sheets discharged therein, a continuously running conveyor means for contacting said sheets and urging them out of said other collector bin, a stop finger means positioned in the path of said sheets to contact said sheets and thereby prevent them from being driven from said other collector bin by said continuously running conveyor means, said stop finger means being movable out of said lateral path in response to a signal from said control means.

5. An automated in-line mailing system as in claim 4 wherein said other collector bin includes idler roller means having at least one idler roller which is lowered into contact with said sheets for urging said sheets against said continuously running conveyor means when said stop finger means is moved out of the path of said sheets from said other collector bin.

6. An automated in-line mailing system as in claim 5 wherein said idler roller means includes a coned end facing said at least one collector bin.

7. An automated in-line mailing system including:

a web supply means for supplying a sheet-web having indicia thereon;

a cutter means attached to said web-supply means for receiving said sheet web and cutting said sheet web into side-by-side individual sheets;

a collector sequencer means for receiving said individual sheets from said cutter means along parallel channels, accumulating said individual sheets respectively received from said adjacent channels in adjacent collector bins, at least one of said adjacent collector bins including an ejecting means for ejecting its contents into the other collector bin, and the other collector bin including an ejecting means for ejecting its contents to further processing equipment; and a control system including a scanner means for scanning said sheet-web indicia upstream of said cutting element, said control system being coupled to said at least one collector bin for ordering said at least one collector bin to eject its contents into the other collector bin in response to indicia read from said sheet web by said scanner.

8. An automated in-line mailing system as in claim 7 wherein said at least one collector bin comprises an abutment wall stopping means for stopping the flow of sheets in a first direction, a continuous lateral conveyor means for contacting said sheets and urging them in a lateral direction, a stop-gate-fingers means positioned in the lateral path of said sheets to contact said sheets and thereby prevent them from being driven in the lateral direction by said lateral conveyor means, said stop-gate-fingers means being movable out of said lateral path in response to a signal from said control system.

9. An automated in-line mailing system as in claim 8 wherein said at least one collector bin includes an idler roller which is lowered into contact with said contents of said at least one collector bin for urging said contents against said continuous lateral conveyor means when said stop-gate-fingers means is moved out of said lateral path.

10. An automated in-line mailing system as in claims 9, 8 or 7 wherein said other collector bin comprises an abutment wall stopping means for stopping said sheets discharged therein, a continuously running conveyor means for contacting said sheets and urging them out of said other collector bin, a stop finger means positioned in the path of said sheets to contact said sheets and thereby prevent them from being driven from said other collector bin by said continuously running conveyor means, said stop finger means being movable out of said lateral path in response to a signal from said control means.

11. An automated in-line mailing system as in claim 10 wherein said other collector bin includes idler roller means having at least one idler roller which is lowered into contact with said sheets for urging said sheets against said continuously running conveyor means when said stop finger means is moved out of the path of said sheets from said other collector bin.

12. An automated in-line mailing system as in claim 11 wherein said idler roller means includes a coned end facing said at least one collector bin.

* * * * *